US007007630B2

(12) United States Patent
Garcia

(10) Patent No.: US 7,007,630 B2
(45) **Date of Patent: *Mar. 7, 2006**

(54) FLEXIBLE MARKER DEVICE

(75) Inventor: Guadalupe C. Garcia, Modesto, CA (US)

(73) Assignee: Worldwide Safety, LLC, Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/763,399

(22) Filed: Jan. 23, 2004

(65) Prior Publication Data

US 2004/0237875 A1 Dec. 2, 2004

Related U.S. Application Data

(63) Continuation-in-part of application No. 10/131,316, filed on Apr. 23, 2002, now Pat. No. 6,766,760.

(60) Provisional application No. 60/442,355, filed on Jan. 23, 2003.

(51) Int. Cl.
*E01F 9/00* (2006.01)

(52) U.S. Cl. ..... 116/63 C; 116/63 P

(58) Field of Classification Search ..... 116/63 P, 116/63 R, 63 C; 40/612; 404/6, 9, 10
See application file for complete search history.

(56) References Cited

U.S. PATENT DOCUMENTS

| | | | | |
|---|---|---|---|---|
| 2,333,273 A | | 11/1943 | Scanlon et al. | 40/125 |
| 2,762,328 A | | 9/1956 | Weig | 116/63 C |
| 2,817,308 A | | 12/1957 | Scanlon | 116/63 C |
| 3,132,624 A | | 5/1964 | Shoemaker | 116/63 C |
| 3,386,409 A | | 6/1968 | Dawson | 116/63 |
| 3,499,413 A | | 3/1970 | Heard | 116/63 C |
| 3,596,628 A | * | 8/1971 | Wright | 116/63 P |
| 3,851,615 A | * | 12/1974 | Grundvig et al. | 116/63 R |
| 3,851,616 A | | 12/1974 | Brown | 116/63 R |
| 4,006,702 A | | 2/1977 | St. Cyr | 116/63 P |
| 4,197,807 A | | 4/1980 | Campbell | 116/63 P |
| 4,256,050 A | | 3/1981 | Barnard | 116/63 C |
| 4,571,118 A | | 2/1986 | Schmanski | 116/63 R |
| 4,588,324 A | * | 5/1986 | Goellner | 404/10 |
| 4,979,461 A | | 12/1990 | Provence, Jr. | 116/63 C |
| 5,199,375 A | * | 4/1993 | Johson | 40/612 |
| 5,375,554 A | | 12/1994 | Yen | 116/63 C |
| 5,421,668 A | | 6/1995 | Cowan et al. | 404/6 |
| 5,439,311 A | | 8/1995 | Hughes | 40/612 |
| 5,488,792 A | | 2/1996 | Kwok | 116/63 C |

(Continued)

FOREIGN PATENT DOCUMENTS

DE 3524084 1/1987

(Continued)

*Primary Examiner*—Diego Gutierrez
*Assistant Examiner*—Travis Reis
(74) *Attorney, Agent, or Firm*—Lumen Intellectual Property Services, Inc.

(57) ABSTRACT

A marker device for increased road safety due to a flexible design is provided. The marker device includes a base with an opening and a flexible means that is positioned over the base. The flexible means has a fast impulse response to direct (contact) and indirect (no-contact) perturbations with one or more parts of the flexible means capable of deflecting up to about 180 degrees from their original position. In one example the deflection ranges from about 15 degrees to about 180 degrees. The marker device increases the likelihood for the marker device to remain upright once the perturbations disappear, therewith increasing the likelihood for the marker device to remain serving as a marker device safely alerting traffic; i.e. its intended purpose.

34 Claims, 12 Drawing Sheets

U.S. PATENT DOCUMENTS

| | | | | |
|---|---|---|---|---|
| 5,888,016 | A | 3/1999 | Ahn | 404/10 |
| 5,993,105 | A | 11/1999 | Chan | 404/10 |
| 6,119,621 | A | 9/2000 | Johnson | 116/63 C |
| 6,247,424 | B1 | 6/2001 | Huang | 116/63 C |
| 6,338,311 | B1 * | 1/2002 | Ho | 116/63 C |
| 6,499,858 | B1 | 12/2002 | Hart | 362/183 |

FOREIGN PATENT DOCUMENTS

| | | |
|---|---|---|
| DE | 3940007 A1 | 6/1991 |
| FR | 2618245 A1 | 1/1989 |

* cited by examiner

FLEXIBLE MARKER DEVICE

CROSS-REFERENCE TO RELATED APPLICATIONS

This application is a continuation-in-part of U.S. patent application Ser. No. 10/131,316 filed on Apr. 23, 2002, now U.S. Pat. No. 6,766,760, and is cross-referenced to and claims priority from U.S. patent application Ser. No. 10/131,316 filed on Apr. 23, 2002, U.S. Provisional Application 60/442,355 filed on Jan. 23, 2003 and PCT Application US03/02116 filed on Jan. 23, 2003, which are all hereby incorporated by reference.

FIELD OF THE INVENTION

The present invention relates generally to traffic marker devices and safety cones that are used to alert or divert vehicles, watercrafts, aircrafts and pedestrians to pass safely around hazards, obstacles or other areas. More particularly, the present invention relates to a flexible safety marker device with a fast impulse response to direct (contact) and indirect (no-contact) perturbations and large flexibility.

BACKGROUND

Traffic or safety cones, are routinely used to direct motorists and pedestrians away from obstacles or dangerous area. These cones are usually brightly colored, hollow conical shaped devices made of a synthetic, rubber or other plastic (See for example U.S. Pat. No. 2,333,273 to Scanlon et al.). Traffic and safety cones are meant to minimize damage to persons or vehicles which may collide with the cones. However, safety cones are still of significant danger to the public. One reason is that, although the traffic cones are made out of a synthetic, rubber or other plastic, they are still relatively rigid and tend to fall over easily when the cones are subject to natural or traffic wind, perturbations by passing traffic or violence. Furthermore, safety cones that are, for instance, run over or hit by a vehicle, could become dangerous objects or obstacles by being airborne or simply laying on the road, in particular to following traffic or surrounding people.

A variety of different self-righting traffic cones have been proposed. For instance, U.S. Pat. No. 3,386,409 to Dietz Company describes to shape the base of the cone in such a manner that the cone is nestable or stackable self-righting in the manner of a self-righting top. The objective of U.S. Pat. No. 3,386,409 is to provide a nestable cone which, when it has been toppled over, will not roll away but will right itself and stand erect near to the position in which it was originally placed. This was accomplished by a hollow molded plastic traffic cone that has a base portion weighted to give a low center of gravity to the cone. The annular bottom of the base is gradually curved outward and upward to provide rockers so the cone is self-righting and is divided into six angularly spaced triangular legs to prevent rolling when the cone is knocked over.

U.S. Pat. No. 5,888,016 to Eui Sig Ahn et al. describes a traffic collar cone that has a delineator having a reflection sheet attached on its upper part. A plug is placed under the sheet having an air inlet and outlet extending upwardly and downwardly there-through. A conical body member is provided, having in its upper end wall an insertion hole in which the plug is mounted. A support panel is provided at the bottom of the body and cone collars are attached on the outer surface of the body member, with vertical spacing between them. The traffic collar cone is made of flexible material and designed to recover its original shape after being impacted, so that injury to collar cone is eliminated or minimized.

U.S. Pat. No. 5,993,105 to Chan describes a safety marker that includes a hollow frusto-conical body and a base having a bowl-shaped main portion and a resiliently flexible skirt for yieldably stabilizing the marker against tipping relative to a supportive surface.

So far the solutions have focused on self-righting of the traffic cone. However, these solutions are still not satisfactory from a safety standpoint since they still are either too rigid or can still relatively easy fall over. Accordingly, there is a need to develop a better traffic cone or marker device that further improves road and traffic safety.

SUMMARY OF THE INVENTION

The present invention provides a new marker device for increased safety due to a flexible design. The marker device of the present invention includes a base with an opening and a flexible means that is positioned over the base. The bottom part of the flexible means is attached to the base. The flexible means has a fast impulse response to direct (contact) and indirect (no-contact) perturbations. Due to the perturbations one or more parts of the flexible means might undergo different degrees of deflection from their original (vertical) position. In general, depending on the type of perturbation (direction of force applied and amount of force applied), one or more parts of the flexible means should be able to allow deflections ranging up to about 180 degrees which is defined from the original (vertical) position. In one example the range of deflection is from about 15 degrees up to about 180 degrees. In case the flexible means is a coil the design of the coil is restricted to the number of loops of the coil in such a manner that during these large deflections the loops maintain spaced from each other; i.e. the loops should for instance not be touching or locking into each other since this would risk that the coil could not restore from the perturbation back to its original position. In addition, touching or intertwined loops might increase the stiffness of the coil during deflections and work against the fast impulse response of the flexible means.

In one embodiment, one or more of the bottom loops of the coil should have a larger diameter than the diameter of the opening of the base. The reason for this is that these bottom loops could get stuck with the base which would jeopardize the restoration of the flexible means from a perturbation.

The marker device of the present invention includes a cover, preferably a mesh-cover, to cover the flexible means. The outside of the cover could include one or more bands of reflective material. In addition, the present invention could include one or more light sources to illuminate the marker device. The light source(s) could be placed inside and/or outside the cover and/or attached to the flexible means and/or the base.

The advantage of the present invention over previous devices is that the present marker device quickly responds and deflects, with one or more parts of the flexible means capable of deflecting up to about 180 degrees from their original position, to direct (contact) and indirect (no-contact) perturbations. The marker device increases the likelihood for the marker device to remain upright once the perturbations disappear, therewith increasing the likelihood for the marker device to remain serving as a marker device safely alerting traffic; i.e. its intended purpose.

BRIEF DESCRIPTION OF THE FIGURES

The objectives and advantages of the present invention will be understood by reading the following detailed description in conjunction with the drawings, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

The marker device of the present invention could be used to alert or divert vehicles, watercrafts, aircrafts and pedestrians to pass safely around hazards, obstacles or other areas. However, the marker device of the present invention is not limited to any particular use and could also be used for recreational or sporting events. Furthermore, the marker device is usually recognized as a cone and is therefore called safety cone. However, the marker device of the present invention is not limited to any particular shape and could also be straight, curved, circular, cylindrical, square, a hexagonal, a tubular marker, any three-dimensional shape type, or any type of shape that is needed or required to alert or divert someone, or mark-off a particular space or area. Therefore, the device of the present invention is referred to as a marker device. Furthermore, there is also no restriction to the size of the particular marker device or safety cone of the present invention.

Figure 1:
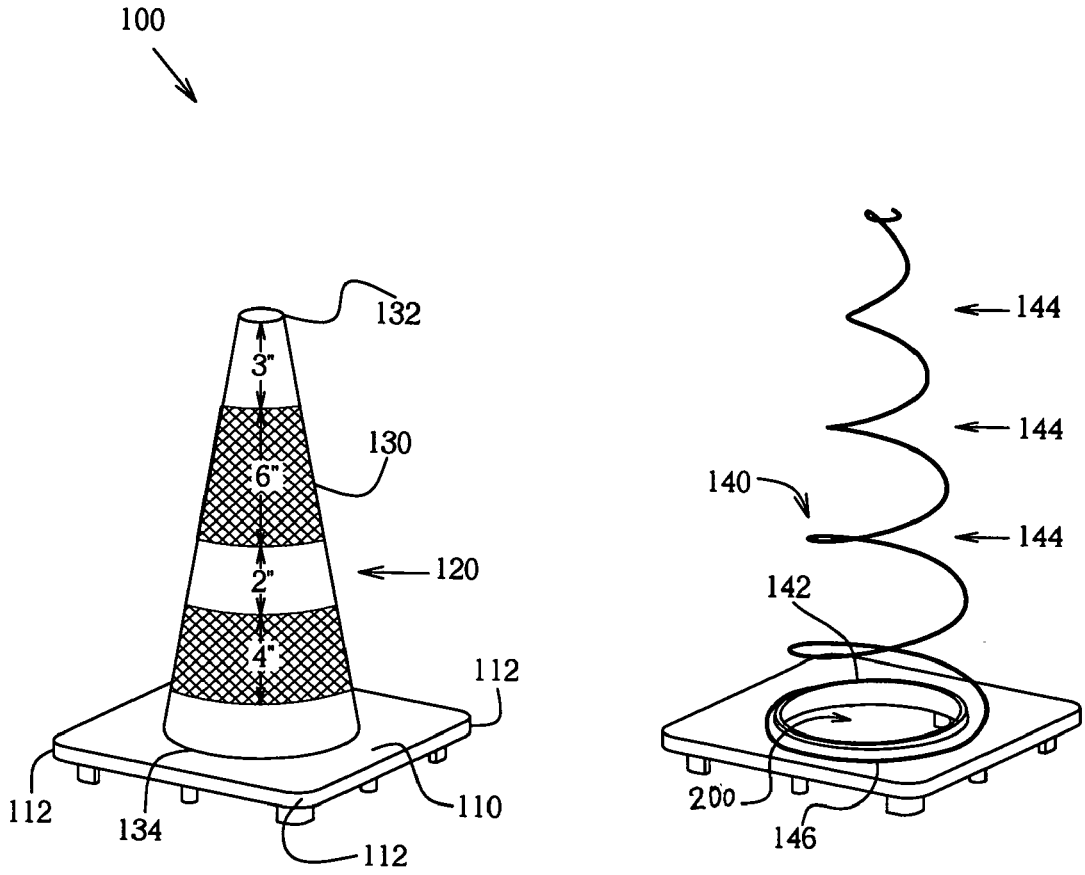
FIG. 1 shows an exemplary embodiment of a marker device according to the present invention.
Figure 2:
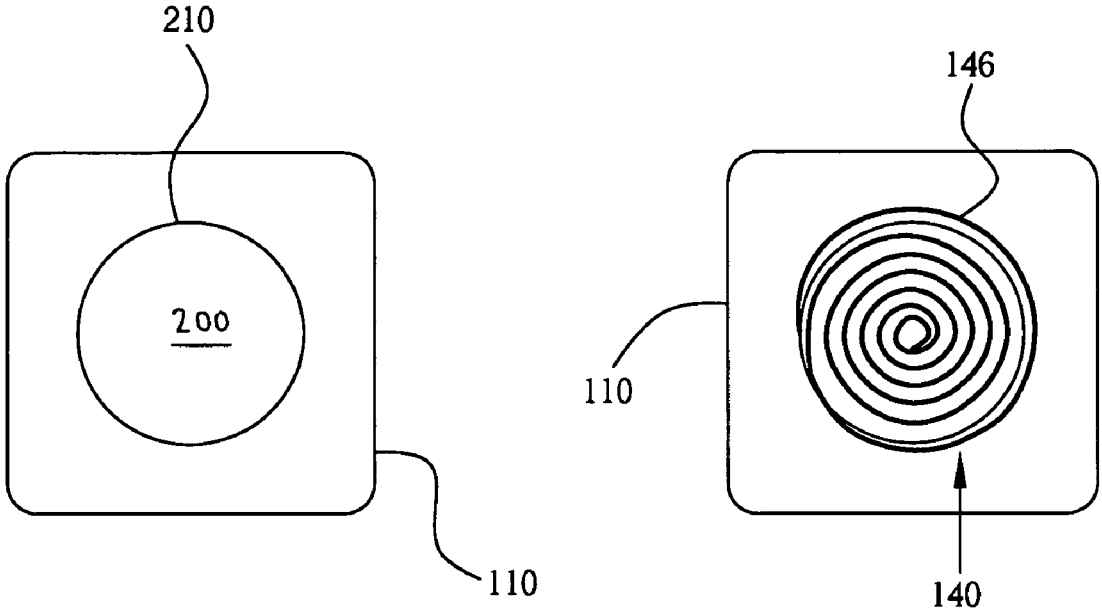
FIG. 2 shows an example of a top view of a marker device according to the present invention.

FIGS. 1–2 show an exemplary embodiment of a marker device 100 according to the present invention. Marker device 100 includes a base 110 with an opening 200 and a cone 120. Opening 200 is preferred to allow stacking of marker devices. The bottom part 142 of flexible means 140 is attached to base 110, preferably centered over base 110, and close to the edge 210 of opening 200, either at the inside of opening 200 or at the top of base 110. Base 100 provides the support of marker device 100 and keeps the marker device on the ground or surface. Base 110 is shown as a square with round edges 112. However, base 110 could take any type of shape and could also be made out of any material as long as it provides the required support. The base of the marker device plays an important role in the stability of the marker device. The weight of the base should be significantly larger than the combined weight of all the components that are positioned above the base (see description infra). Furthermore, the dimensions of the base should be large enough to support, in a stable fashion, the entire marker device with or without perturbations. The measurement (length and width) of base 110 could be, but is not limited to, about 14" by about 14", which is the standard base size for conventional safety cones in the U.S.A. (e.g. 18" and 28" high cones). The materials that could be used for the base are, for instance, but not limited to, rubber, recyclable rubber, soft/hard plastic, PVC, any type of wood including bamboo or wood compositions, metal, or the like.

Cone 120 includes a flexible lightweight cover 130 that covers a flexible means 140. Preferably, cover 130 is made out of a flexible material that allows cone 120 to easily flex, bend or fold. Cover 130 should not resist or minimal resist the movement of flexible means 140. The top 132 and bottom 134 of cover 130 could be attached to flexible means 140. Instead of attaching bottom 134 of cover 130 to flexible means 140, bottom 134 could be attached to base 110. The type of means for connecting cover 130 is, for instance, but not limited to, stitches, clamp(s), glue, Velcro, a ring (See FIG. 13) or the like. However, cover 130 could also fit tight over flexible means 140 and in this case there is no need for a connecting means to connect cover 130.

In a preferred embodiment, the cover should have air-passing capabilities, e.g. by having a mesh cover, to make it less wind resistant. Examples of cover materials are for instance, but not limited to, a mesh-type material, vinyl, canvas, polyester, or the like. Furthermore, the outside of the cover could include all kinds of shapes and/or reflective material. Preferred shapes (reflective collar(s), stripes, or other types of regulatory shapes or signs) are the ones recommended by the Government (Federal, State/Province or Local; e.g. the U.S. Department of Transportation including the FAA and/or the Federal Highway Administration) and include common traffic control or warning signs. FIG. 1 shows an example of a cone 100 with a cover 130. Cover 130 includes two bands of reflective material that are positioned at two distinct positions on cover 130 according to U.S. Government regulations. FIG. 1 shows the first reflective band (shaded) positioned at about 3" (inches) from the top of cover 130 and this first band is about 6" (inches) in height. FIG. 1 shows the second reflective band (shaded) positioned at about 2" (inches) from the bottom of the first reflective band and this second band is about 4" (inches) in height. Any other type of shape or sign can be included and is depended on the type of application. It is possible to use a reflective material that can be attached/assembled to the cover using heat, glue, tape, Velcro, sewing or the like. An example of a suitable reflective material is the 8710 reflective material (from 3M Worldwide Corp.; See U.S. Pat. No. 6,656,319 to Innovative Properties Company, which is hereby included by reference for all that it discloses) that also has the benefit of about 500 candlelight power. The present invention is not limited to 8710 reflective material or to a reflective material with about 500 candlelight power, since any type of reflective material could be used each with a different amount of reflective intensity (higher or lower), (see e.g. Reflecto-Lite Inc.).

Flexible means 140 is, for instance, a coil that is shaped as a cone when marker device 100 is meant to be a safety cone. Flexible means 140 provides for the flexibility of marker device 100. The key idea of the present invention is that the base provides stable support on the ground or surface, and the flexible means is in either its original position or a deviated position from the original position caused by indirect (non-contact) or direct (contact) perturbations. Examples of indirect (non-contact) perturbations are, for example, but not limiting to, perturbations caused by natural wind, traffic wind, ground-shaking caused by earthquakes, falling or being dropped on the ground (see also description infra), or the like. Examples of direct (contact) perturbations are, for example, but not limiting to, perturbations from vehicles by hitting, running over or running into the marker device, violence, or the like.

The applied (direct and/or indirect) perturbation force (F) applied at the flexible means for a period of time is an impulse, which is the act of applying force suddenly (See e.g. Webster Dictionary). The mechanical definition of impulse is the action of a force during a very small time interval (See e.g. Webster Dictionary and Oxford Dictionary of Physics). To sustain, without the marker device permanently fallen over, direct and indirect perturbations, the material properties of the flexible means of the present invention require a fast impulse response to these direct and indirect perturbations; i.e. the flexible means needs to respond fast by flexing, bending and/or folding to any direction in response to the suddenly applied (indirect and/or direct) force as shown in FIGS. 3–6 and could, for instance, bend sideways, downward or even flex/extend upward. In other words, flexible means deviates from its original position (i.e. natural or neutral position in case flexible means is a coil or a spring). The direction and amount of deviation from the original position depends on the amount and direction of the perturbation force. Once the perturbation force is removed or disappears, flexible means restores from the deviated position to its original position.

Figure 3:
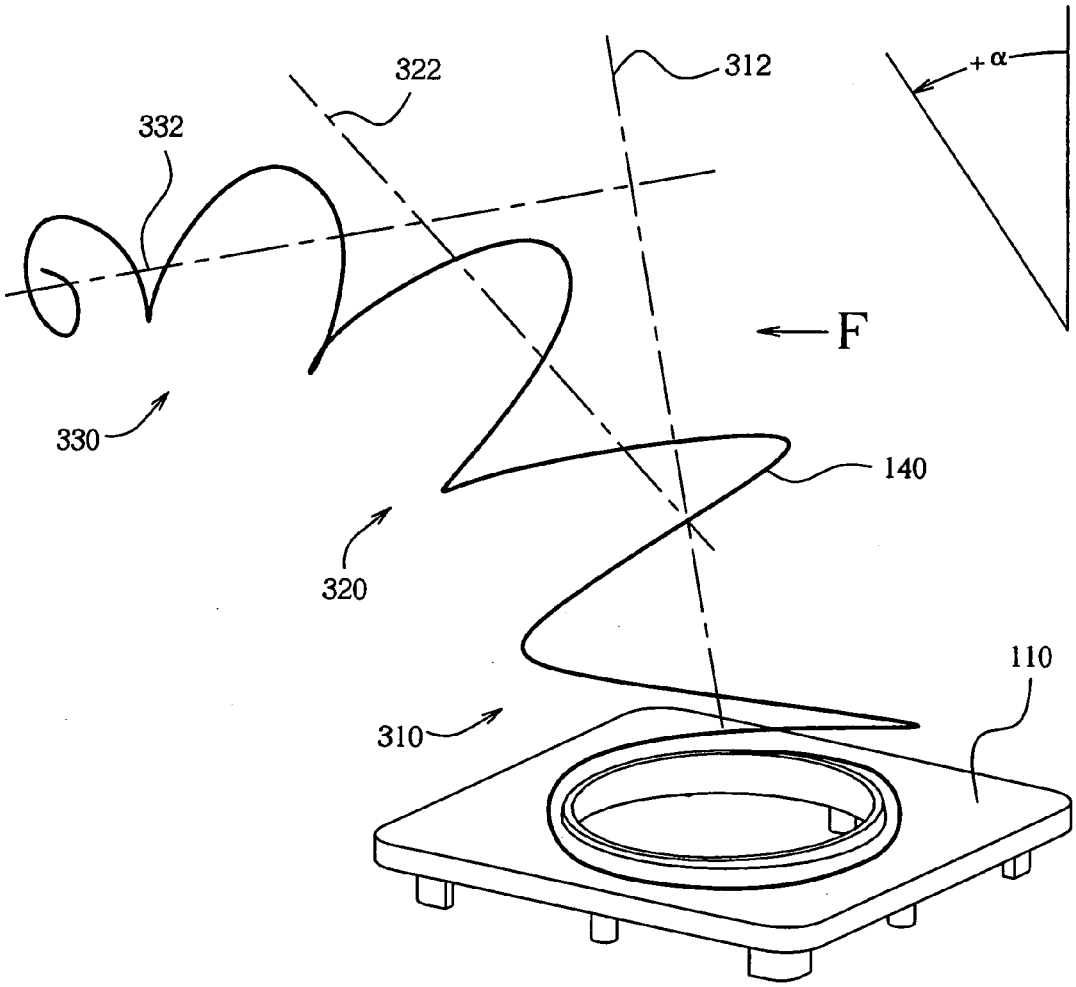
FIGS. 3–5 show exemplary embodiments of the flexibility and degree of bending/deflection of parts of the flexible means of a marker device due to a perturbation according to the present invention.
Figure 4:
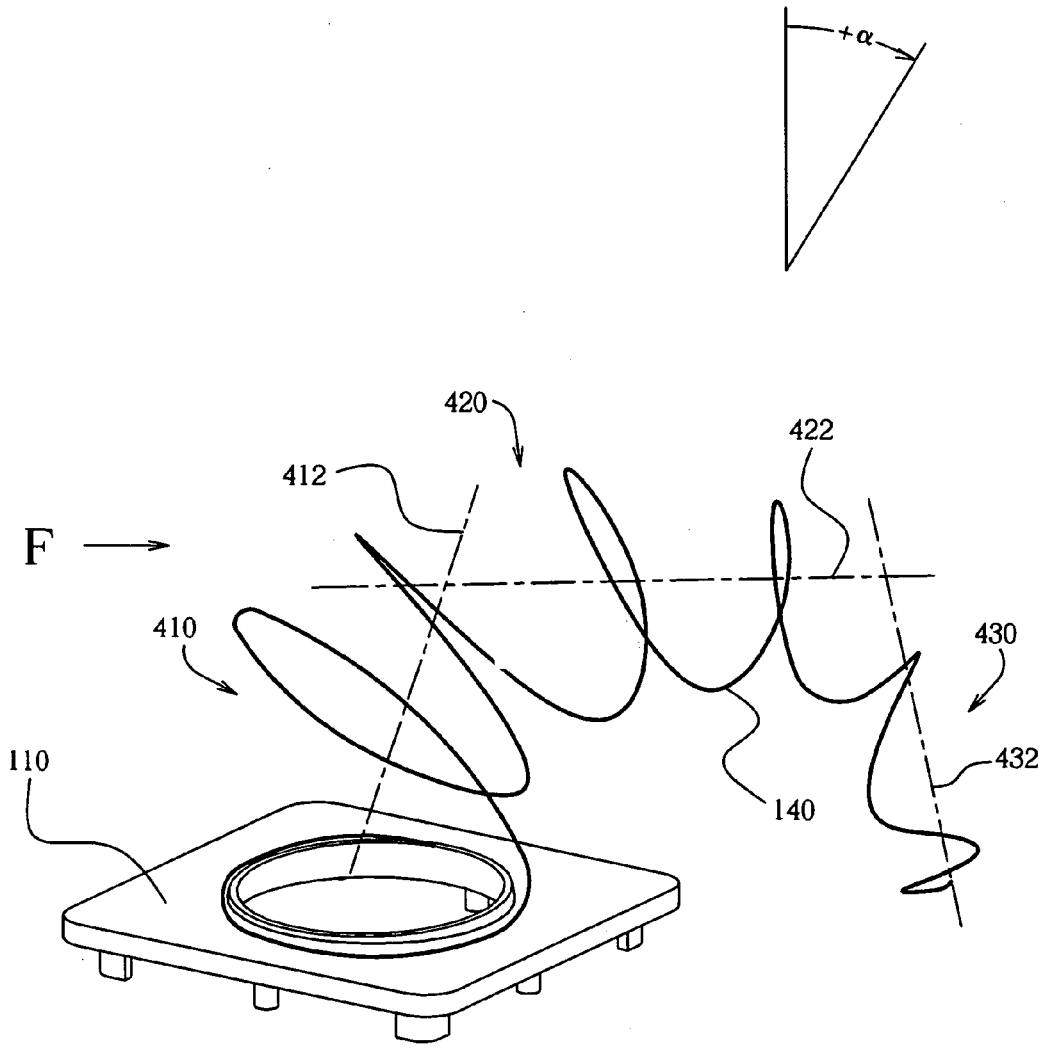

As shown in FIG. 3–6 the degree of flexibility or deflection ($\alpha$) from original (vertical) position of the flexible means is significant. Due to the perturbations different parts of the flexible means undergo different degrees of deflection from their original (vertical) position. For example, parts 310, 320, 330 as shown in FIG. 3, show a deflection of about 11 degrees, about 31 degrees, about 100 degrees (indicated by lines 312, 322, 332), respectively. In another example, part 410, 420, 430 shown in FIG. 4, show a deflection of about 21 degrees, about 90 degrees, about 170 degrees (indicated by lines 412, 422, 432), respectively. A deflection of up about 180 degrees for instance could require a perturbation whereby the top of the cone is brought downward to the direction of the ground or base.

Figure 5:
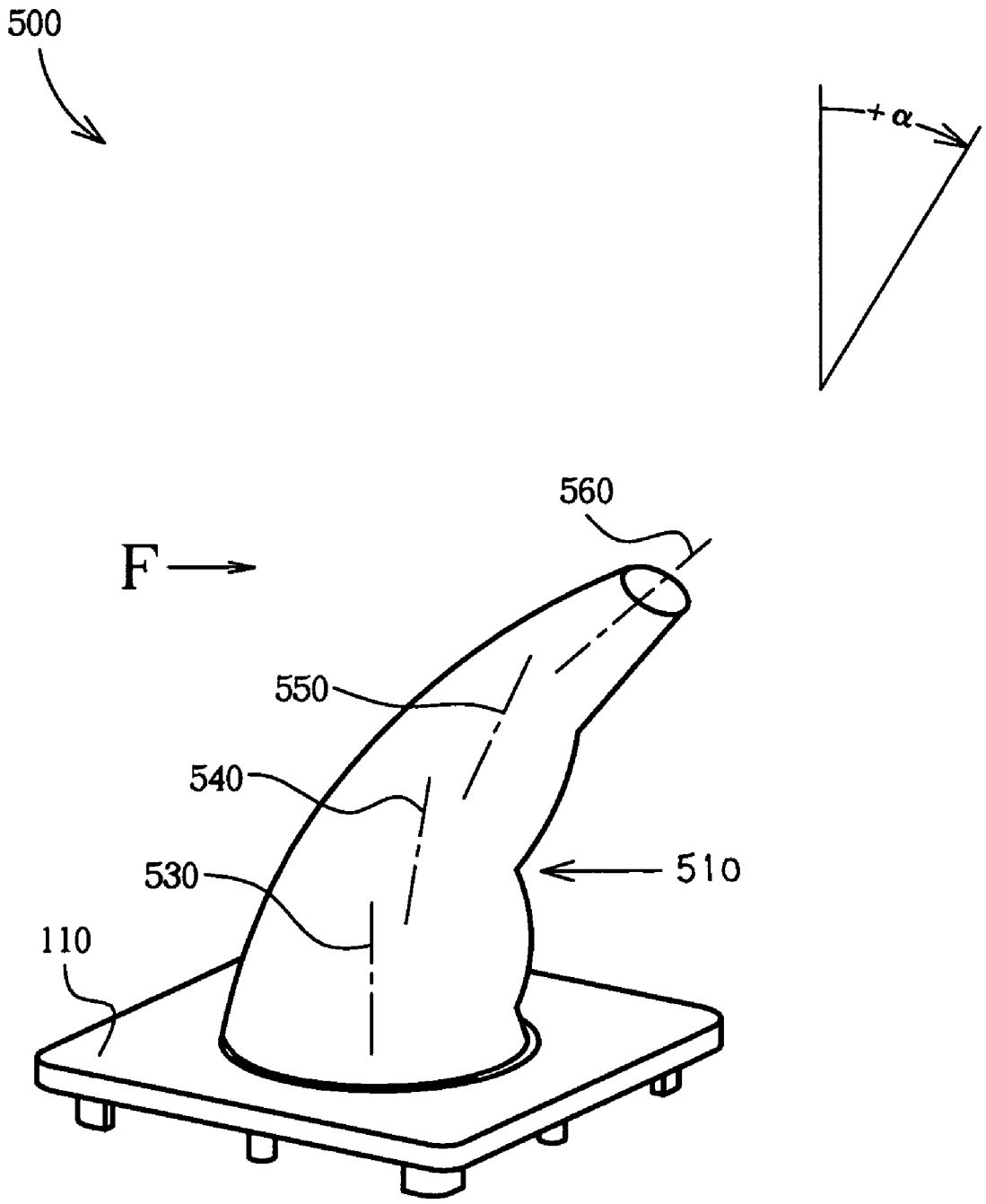

FIG. 5 shows an example of marker device 500 now including a cover over the flexible means subject to a perturbation force 510 that makes flexible means to quickly flex, bend or fold away from its original (upright) position with deflections 530, 540, 550, 560 of different parts of the cone (flexible means and cover). In this example part 530, 540, 550, 560 have a deflection of about 2 degrees, about 12 degrees, about 26 degrees, about 52 degrees, respectively.

In general, depending on the type of perturbation (direction of force applied and amount of force applied), one or more parts of the flexible means should be able to allow deflections of up to about 180 degrees which is defined from the original (vertical) position. In one example the range of deflection is from about 15 degrees up to about 180 degrees. In case the flexible means is a coil the design of the coil is restricted to the number of loops of the coil in such a manner that during these large deflections the loops maintain spaced from each other; i.e. the loops should for instance not be touching or locking into each other since this would risk that the coil could not restore from the perturbation back to its original position. In addition, touching or intertwined loops might increase the stiffness of the coil during deflections and work against the fast impulse response. In general, depending on the height of the marker device between 2–10 loops could be used; i.e. the number of loops spaced between the base and the top of the cone leaving a large space 144 between the loops. Examples of a type of material for the flexible means are, for example, but not limited to, a metal (e.g. aluminum, steel, etc.), a carbon, a graphite, a wood (including bamboo), a fiberglass, a plastic, a rubber or the like.

In one embodiment, in particular for the case that the flexible means is a coil, it is also important that during the perturbations the coil does pop through opening 200. For instance, if the largest diameter of the loops of the coil is the same as or less than the diameter of the opening, then during perturbations (e.g. bending of the coil or pressing the coil downwards) the coil could pop through the opening and one of the bottom loops could get stuck with or under the base. This would be a concern since the coil can then no longer properly restore from the perturbed position back to its original position. To prevent this from happening, the coil in this embodiment would then require that at least one of the bottom loops, e.g. loop 146 of coil 140 has a larger diameter than the diameter of the opening (see top view of FIG. 2 where different in diameter is shown). In one exemplary embodiment, opening could have a diameter of about 10" and the diameter of at least one of the bottom loop(s) is about 12.5". The present invention is not limited to the number of loops with larger diameters than opening or any particular dimensions. In an alternative embodiment a small recess at the edge of the opening (not shown) could be created, still leaving a large enough opening for stacking with another marker device, to provide support to the coil and prevent it from popping through.

Figure 6:
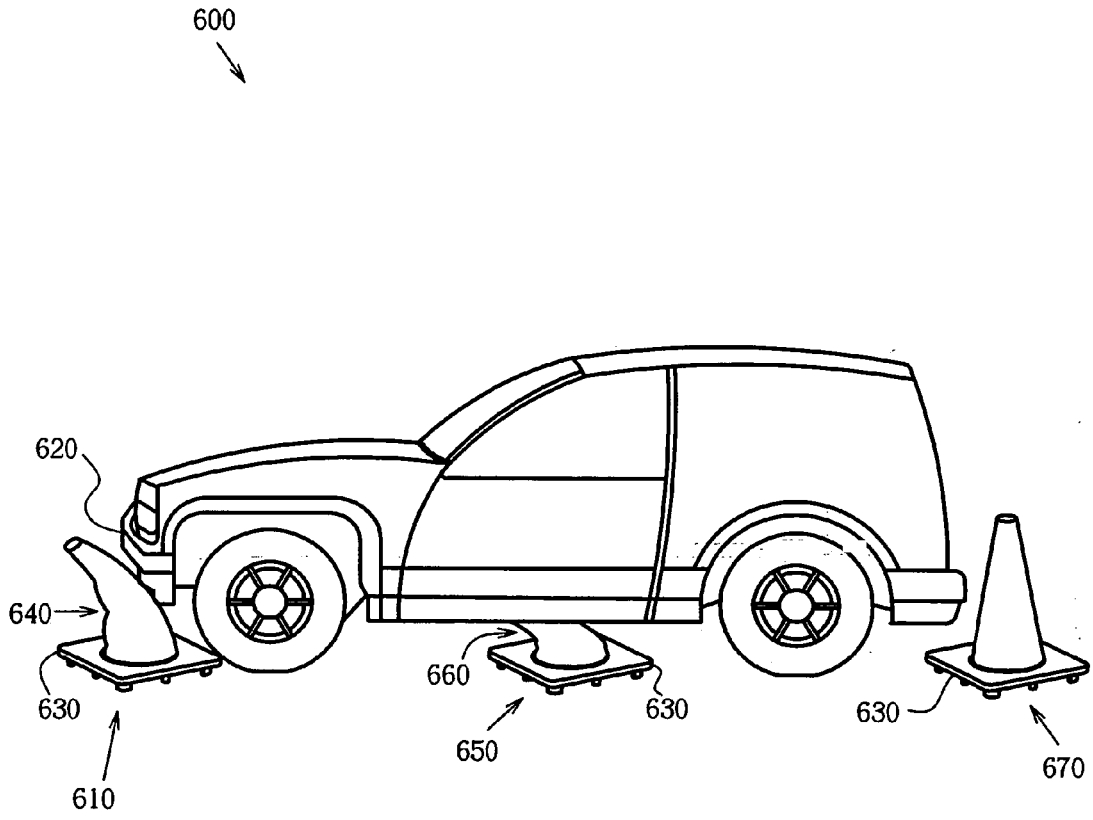
FIG. 6 shows an example of the degree of flexibility of the marker device when a marker device is hit and run over by a car according to the present invention.

FIG. 6 shows a situation where a moving car 600 runs into and over a marker device of the present invention, i.e. a direct (contact) perturbation force. When car 600 hits marker device 610 with bumper 620 (i.e. a high speed impact), base 630 remains on the ground and only the flexible means and cover bend as indicated by 640. In the example of 640, the impact of the car with the flexible means causes the original position of the flexible means (see e.g. FIG. 1) to quickly change to deviated position 640 with large deflections of different part of the cone (flexible means and cover). To sustain such an impact, the flexible means requires a fast impulse response. When marker device 650 is under the car, base 630 could rock but does not permanently tip over mainly due to its weight and the flexible means responding (see 660) to the impact and perturbation. The flexible means and therewith the cone also quickly re-positions itself to the original (upright) position when the car is no longer on top of the marker device as indicated by 670. During the perturbation, the base of the marker device of the present invention might undergo some rocking motion(s), however, once the perturbation disappears the base of the marker device will return to its original and stable position.

Another example (not shown) is that the marker device of the present invention could be dropped down to the ground (which results in an indirect perturbation to the flexible means, through a direct impact to the base), for instance, but not limited to, from a car or a truck that is delivering several marker devices to an area to, for instance, block an obstacle. The impact of the landing of the marker device on the ground causes sudden and fast perturbations to the flexible means. After landing on the ground, the marker device of the present invention might initially rock but will come to their original and stable position once the rocking motions oscillate out.

The likelihood that the marker device of the present invention remains in that position is facilitated by a very low center of gravity (close to the ground or supporting surface) of the marker device. The low center of gravity is mainly due to a relatively heavier base compared to the combined weight of the flexible means and cover that over positioned over the base (flexible means and cover are preferably made of lightweight material(s)). The center of gravity of the marker device could virtually be close to the top of the base or somewhere in the base in case the difference between the weight of the base and combined weight of the flexible means and cover that are positioned over the base is large as a person of average skill would readily appreciate. Furthermore, the fact that the flexible means (and cover) bends at different spots, with the loops maintaining space between each other (i.e. without loops touching each other or locking into each other), significantly reduces the torque that the perturbed flexible means produces onto the base (this in contrast to existing traffic safety cones or marker devices which have a relatively stiff top/cone part or where coil loops are restricting even small deflections such as less than about 10 degrees). The reduced torque improves the stability of the base and therewith the stability of the marker device of the present invention.

Figure 7:
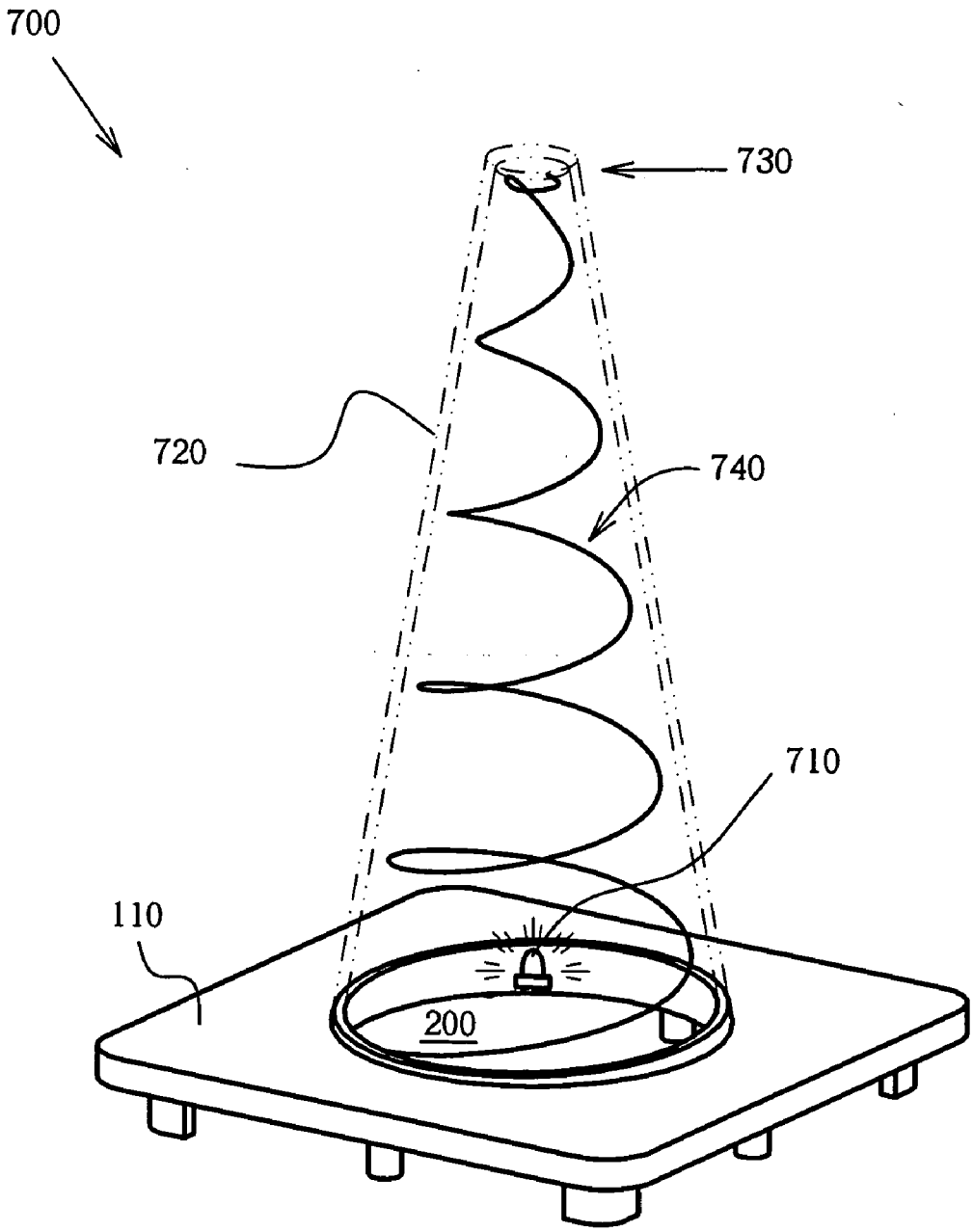
FIG. 7 shows an example of a light source inside of a marker device according to the present invention.

The marker device of the present invention could include one or more light sources such as light source 710 shown in marker device 700 in FIG. 7. Light source 710 could be positioned anywhere inside cover 720 to illuminate the inside of cover 720. However, light source 710 could also be positioned to the base or flexible means. In case a light source is included inside cover 710, it would be preferred that the material of the cover is transparent to light so that the marker device becomes visible in the dark or in situations of poor visibility. Light source 710 could be any type of light source and is not limited to a particular type or mechanism. Light source 710 is preferably lightweight and small. Light source 710 could be positioned by or near opening 200 of base 110, but could also be positioned near the top 730 of the flexible means 740. In general, the light source(s) could be placed at the base, flexible means or cover (inside or outside). The marker device of the present invention could also have a sensor to turn on the light source. The sensor could, for instance, be positioned at the bottom of the base. Once the marker device is placed on the ground or surface, the sensor turns on the light source and the marker device becomes lit. The sensor could, for instance, be a mechanical switch. However, the sensor is not limited to a mechanical switch since it could also be a light-sensitive sensor that turns on the light source depending on whether it is, for instance, daytime or nighttime. In addition, the sensitivity of the sensor can also be set so that it will be turned on when the visibility becomes less.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For instance, in order to meet the stated (explicit or implied) objectives and advantages of the present invention, the marker device and its components could be designed, manufactured and assembled in a variety of different ways with a variety of compatible different of materials and dimensions. The discussion infra provides some examples of the different materials, dimensions as well as possible assemblies and variations.

Generally speaking, the height of the marker device of the present invention is not restricted. However, the art as well as Government (Federal, State/Province or Local) regulations teach several specific dimensions/heights for safety traffic cones. Examples of such dimensions in the U.S.A. are, for instance, but not limited to, a 14-inch high cone, 18-inch high cone, 28-inch high cone or a 36-inch high cone. As a person of average skill in the art would readily appreciate, the height of the marker device is mostly dependent on the type of use or application as well as on any type of Government regulations or requirements (Federal, State/Province or Local), which (may) vary in different countries/parts around the World.

Figure 8:
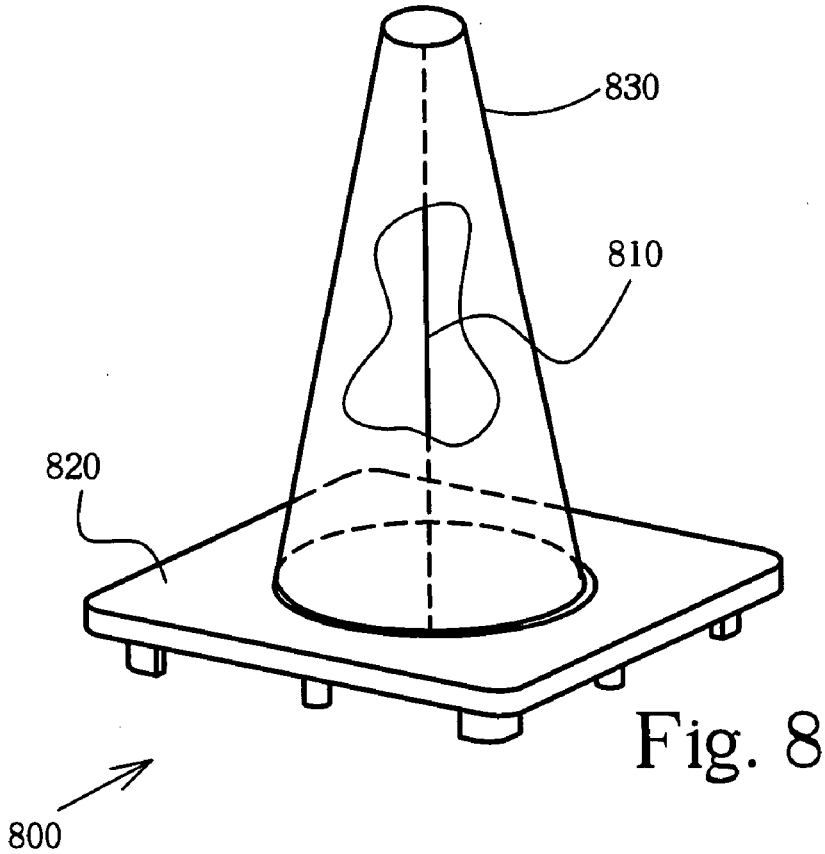
FIG. 8 shows an example of a marker device with one rod as flexible means according to the present invention.
Figure 9:
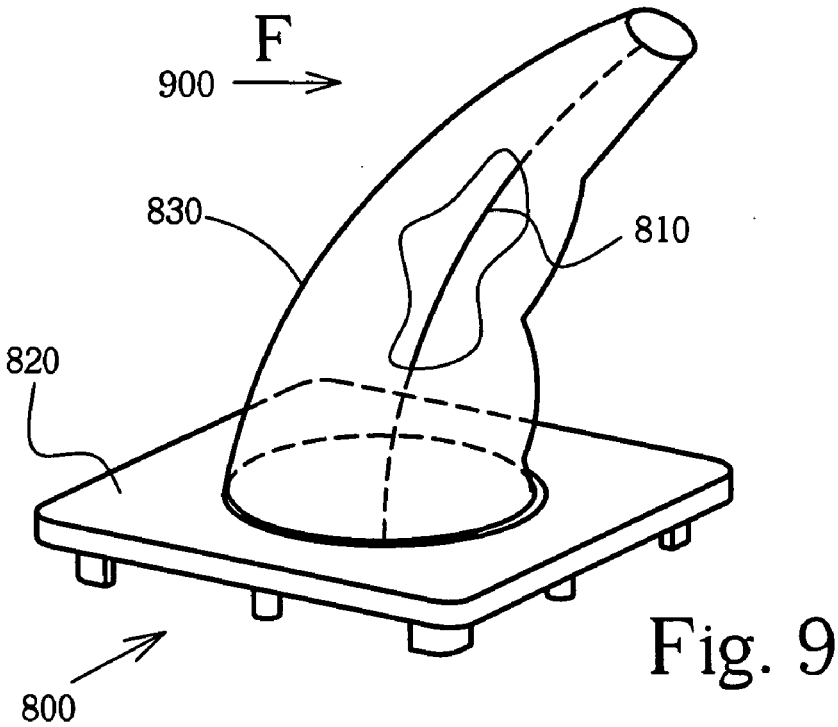
FIG. 9 shows an example of a position of the marker device shown in FIG. 8 due to a perturbation according to the present invention.
Figure 10:
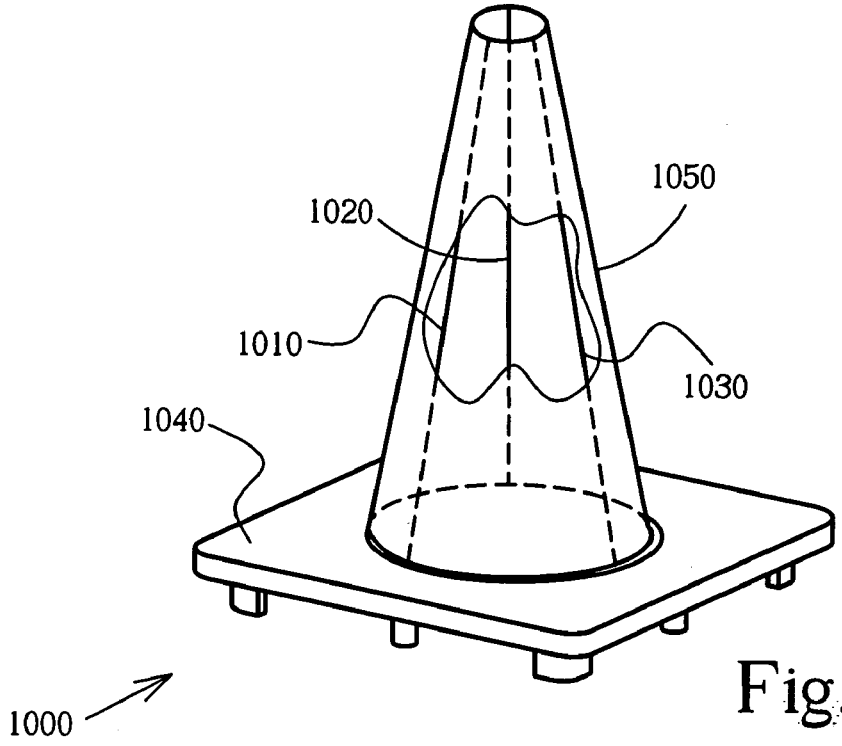
FIG. 10 shows an example of a marker device with three rods as flexible means according to the present invention.
Figure 11:
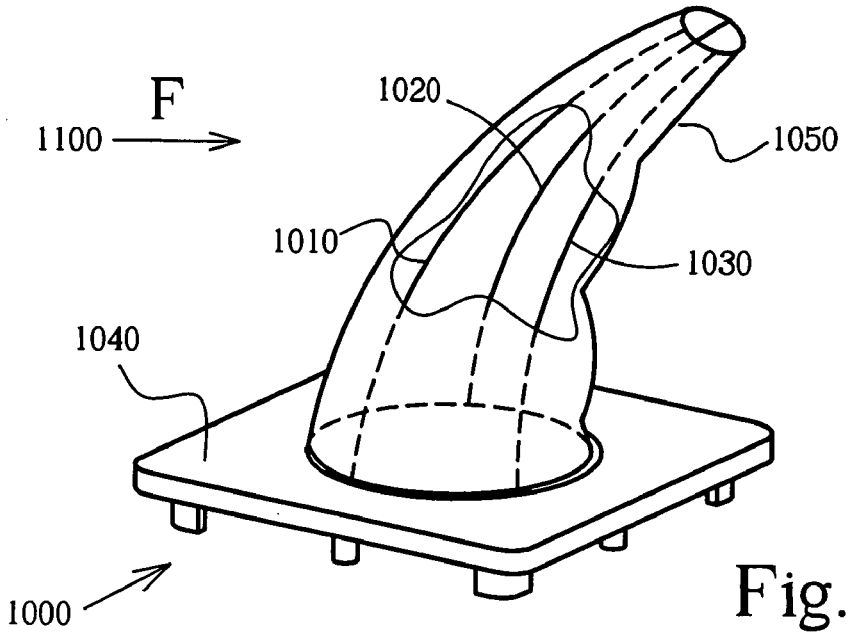
FIG. 11 shows an example of a position of the marker device shown in FIG. 10 due to a perturbation according to the present invention.

The flexible means could also include one or more rods as long as the physical characteristics of the rod(s) meet the objectives and advantages of the present invention as they are discussed supra; i.e. the rods have a fast impulse response to direct and indirect perturbations. This includes the need to allow for large deflections of one or more parts of the rod(s) as described supra. FIG. 8 shows an example of a safety cone 800 in which the flexible means is based on one rod 810 that is positioned over base 820. Rod 810 could, for example, be attached with its bottom end to base 820 and with its top end to the top of cover 830 (e.g. a ring). The cone shape of exemplary safety cones as it is discussed supra, is defined and determined predominantly by the flexible means. However, in case of marker device 800, the cone shape has to be determined by cover 830 that is placed over rod 810. FIG. 9 shows safety cone 800 subject to a perturbation 900, whereby rod 810 is bend due to perturbation 900. FIG. 10 shows examples of a safety cone 1000 in which the flexible means is based on three rods 1010, 1020, and 1030 that are positioned over base 1040. Rods 1010, 1020, and 1030 could, for example, be attached with their bottom ends to base 1040 and with their top ends to the top of cover 1050 (e.g. a ring). FIG. 11 shows safety cone 1000 subject to a perturbation 1100, whereby rods 1010, 1020, and 1030 are bend due to perturbation 1100.

Figure 12:
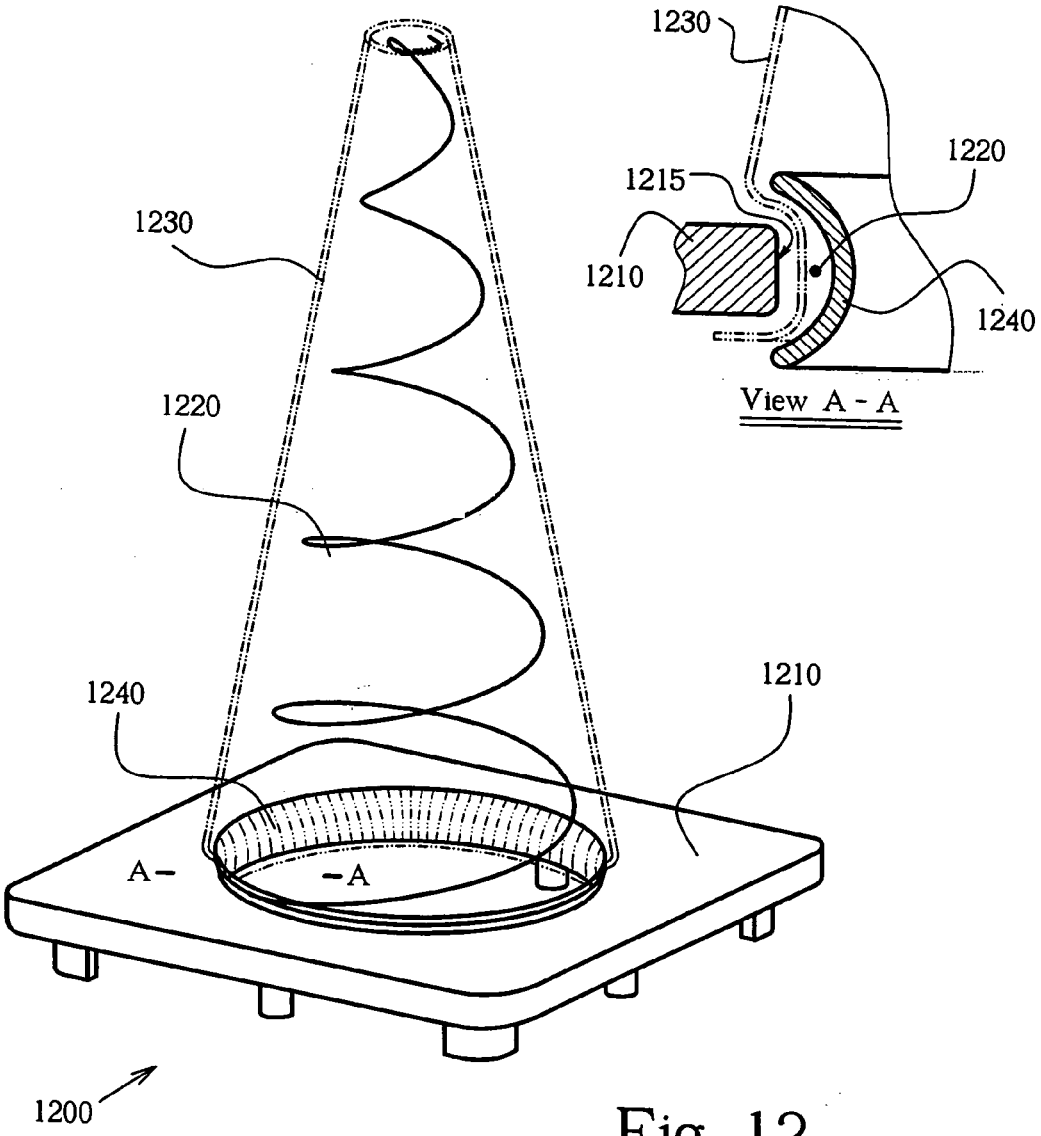
FIG. 12 shows a cross section view of an exemplary marker device assembly according to the present invention.

FIG. 12 shows an example of a marker device assembly 1200 with a base 1210, a spiral 1220, a cover 1230 and a ring 1240 using a cross sectional view of marker device assembly 1200. Ring 1240 is used as a sort of quick-connector to assemble the modular components (i.e. base 1210, spiral 1220 and cover 1230) of the marker device. Note that for clarity purposes in the inset figure, only part of the bottom ring of spiral 1220 is shown and spiral 1220 should in fact extend upward as shown by 1200. The key idea of ring 1240 is to position spiral 1220 and cover 1230 against the inner edge 1215 of base 1210. Ring 1240 could be made out of any type of material (e.g. a plastic, rubber or polyester) as long as it has enough strength to hold together base 1210, spiral 1220 and cover 1230 as well as enough flexibility to assemble (de-assemble) these three parts together (apart).

Figure 13:
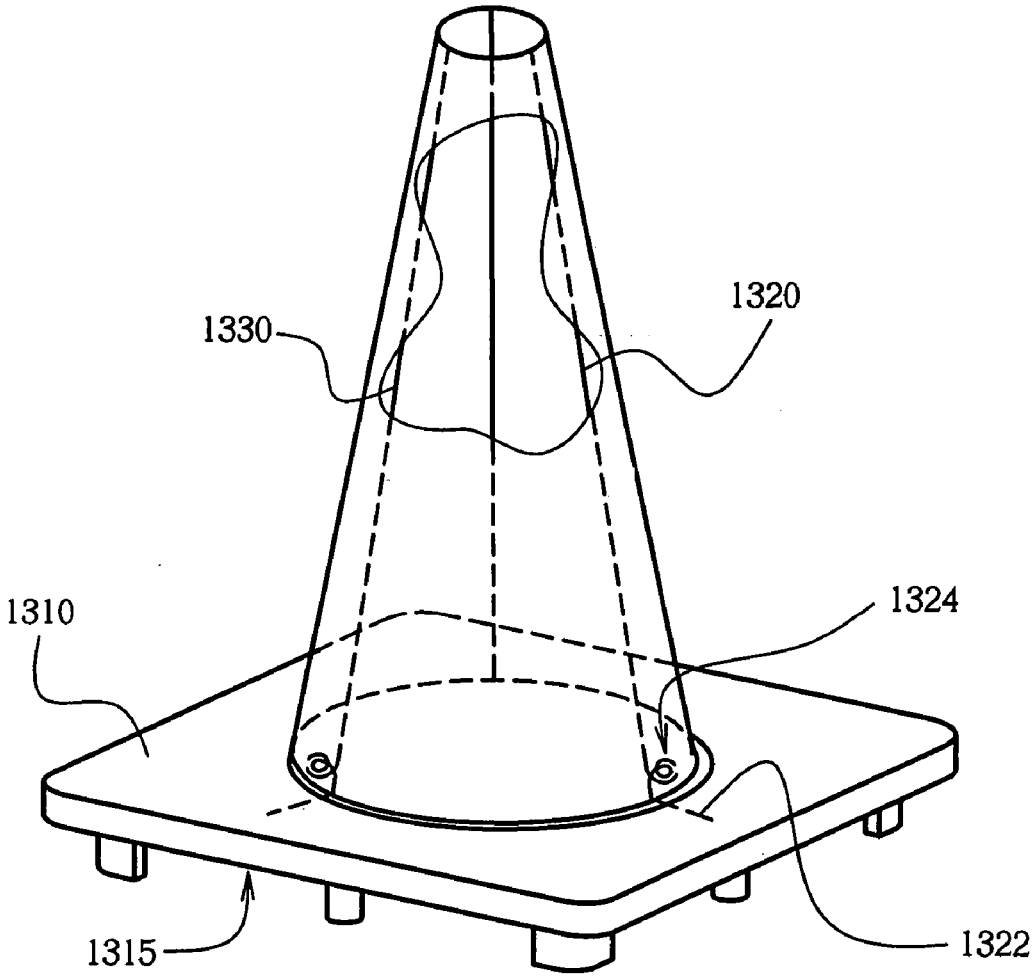
FIG. 13 shows an example of a rod with a spring to enhance the flexibility of the rod, i.e. flexible means, according to the present invention.

FIG. 13 shows an example of how base 1310 and flexible means could be connected in case the flexible means includes one or more rods 1320 and 1330 each with a fast impulse response to direct and indirect perturbations. For example, rod 1320 includes an end part 1322 that could be positioned more or less parallel to the bottom 1315 of base 1310. Rod 1320 could include a spring 1324 as an integral part of rod 1320 to ensure the necessary flexibility of the flexible means. However, the question whether spring 1324 is necessary depends on the physical characteristics (e.g. flexibility) of rod 1320.

Figure 14:
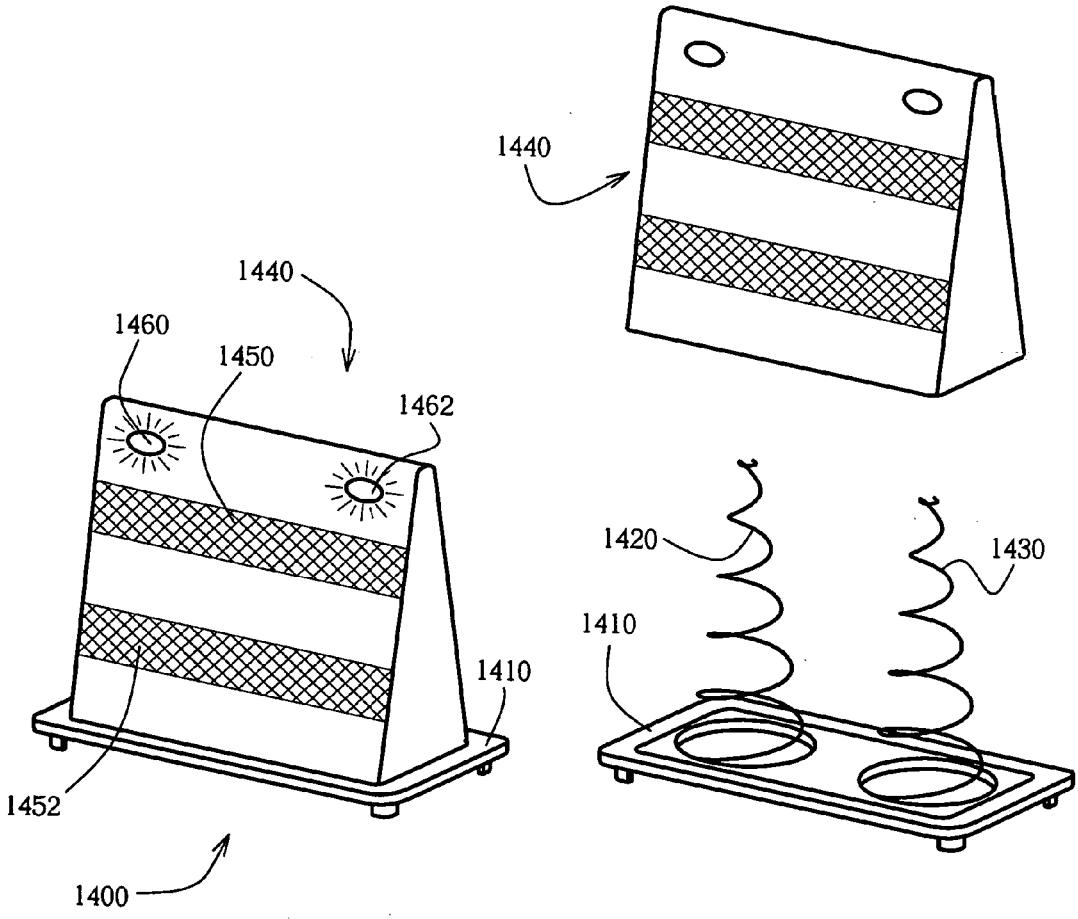
FIG. 14 shows an example of a marker device with two or more flexible means according to the present invention.

The present invention is also not limited to a marker device with one flexible means since it could also include two or more flexible means each with a fast impulse response to direct and indirect perturbations. This includes the need to allow for large deflections of one or more parts of each of the flexible means as described supra. FIG. 14 shows an exemplary embodiment of a marker device 1400 in the form of a barricade that includes two or more flexible means 1420 and 1430 that are positioned over base 1410. In case of a barricade, base 1410 typically has a rectangular shape. Base 1410 could have opening that could be advantageous for stacking purpose, however, this is not necessary. The two or more flexible means 1420 and 1430 could be positioned to base 1410 is a similar manner as discussed supra for a single flexible means. Marker device 1400 could also include: (1) a cover 1440 that covers the two or more flexible means, (2) one or more shapes and/or reflective materials 1450 and 1452, and/or (3) one or more light sources placed on the outside (e.g. 1460 and 1462) of cover 1440 or at the inside of cover 1440 (not shown in FIG. 14, but discussed supra). It should be clear to a person of average skill in the art that the teachings for a marker device with one flexible means, as discussed supra, also apply to a marker device with two or more flexible means. Furthermore, it should be clear to a person of average skill in the art that a marker with two or more flexible means is not limited to a barricade, since such a marker device could also be a fence-like structure as long as all these variations include the advantages and objective as stated and discussed supra in terms of safety, flexibility when subject to direct or indirect perturbations. A fence-like marker device according to the present invention could be small but also significantly wide, for instance to fence-off a yard, a street part etc. Imagine that a car runs into such a wide fence, then the part of the fence where the car runs into flexes, bends etc. according to the teaching supra and restores to its natural original position when the car (read perturbation) has disappeared.

All such variations are considered to be within the scope and spirit of the present invention as defined by the following claims and their legal equivalents.

What is claimed is:

1. A safety marker device, comprising:

(a) a base having an opening for stacking with another safety marker device;

(b) a flexible means having a fast impulse response to direct and indirect perturbations, said flexible means positioned over said base, wherein said base supports said flexible means; and (c) a cover to cover said flexible means, wherein said cover is made of a flexible material and allows said fast impulse response to said direct and indirect perturbations, wherein said base being heavier than the combined weight of said flexible means and said cover, wherein said flexible means maintains in an original position in absence of said direct and indirect perturbations, and flexes from said original position to a bent position in presence of said direct and indirect perturbations, wherein said bent position is characterized by one or more parts of said flexible means flexed from their original position up to about 180 degrees with respect to said base, and wherein said safety marker device has a low center of gravity mainly due to said heavier base, whereby said low center of gravity facilitates in restoring said original position and whereby said heavier base facilitates said flexing.

2. The device as set forth in claim 1 wherein said deflections range from about 15 degrees to about 180 degrees.

3. The device as set forth in claim 1, wherein said base, said flexible means and said cover are modular components which are combined by means of a quick-connector or a ring.

4. The device as set forth in claim 1, wherein said cover is a meshed cover.

5. The device as set forth in claim 1, wherein said cover comprises reflective material.

6. The device as set forth in claim 5, wherein said reflective material comprises one or more reflective bands.

7. The device as set forth in claim 5, wherein said reflective material comprises two reflective bands, wherein the first reflective band is positioned at about 3" (inches) from the top of said cover and said first band is about 6" (inches) in height, and wherein the second reflective band is positioned at about 2" (inches) from the bottom of said first reflective band and said second band is about 4" (inches) in height.

8. The device as set forth in claim 1, wherein said flexible means has one or more rods.

9. The device as set forth in claim 1, wherein said base is substantially square.

10. The device as set forth in claim 1, further comprising a light source.

11. A safety cone, comprising:

(a) a base having an opening for stacking with another safety marker device;

(b) a cone-shaped spring with 2 to 10 loops space between said base and the top of said cone-shaped spring, having a fast impulse response to direct and indirect perturbations, said cone-shaped spring positioned over said base, wherein said base supports said cone-shaped spring; and (c) a cover to cover said cone-shaped spring, wherein said cover is made of a flexible material and allows said fast impulse response to said direct and indirect perturbations, wherein said base being heavier than the combined weight of said cone-shaped spring and said cover, wherein said cone-shaped spring maintains in an original position in absence of said direct and indirect perturbations, and flexes from said original position to a bent position in presence of said direct and indirect perturbations, wherein said bent position is characterized by one or more parts of said cone-shaped spring flexed from their original position up to about 180 degrees with respect to said base, and wherein said safety marker device has a low center of gravity mainly due to said heavier base, whereby said low center of gravity facilitates in restoring said original position and whereby said heavier base facilitates said flexing.

12. The safety cone as set forth in claim 11, wherein said deflections range from about 15 degrees to about 180 degrees.

13. The safety cone as set forth in claim 11, wherein the loops of said coil maintain spaced from each other during said perturbations, wherein said perturbations deflect one or more parts of said coil from their original position up to about 180 degrees.

14. The safety cone as set forth in claim 13, wherein said deflections range from about 15 degrees to about 180 degrees.

15. The safety cone as set forth in claim 11, wherein the diameter of one or more of the bottom loops of said coil has a larger diameter than said opening.

16. The safety cone as set forth in claim 11, wherein said base, said coil and said cover are modular components which are combined by means of a quick-connector or a ring.

17. The safety cone as set forth in claim 11, wherein said cover is a meshed cover.

18. The safety cone as set forth in claim 11, wherein said cover comprises reflective material.

19. The safety cone as set forth in claim 18, wherein said reflective material comprises one or more reflective bands.

20. The safety cone as set forth in claim 18, wherein said reflective material comprises two reflective bands, wherein the first reflective band is positioned at about 3" (inches) from the top of said cover and said first band is about 6" (inches) in height, and wherein the second reflective band is positioned at about 2" (inches) from the bottom of said first reflective band and said second band is about 4" (inches) in height.

21. The safety cone as set forth in claim 11, wherein said base is substantially square.

22. The safety cone as set forth in claim 11, further comprising a light source.

23. A safety marker device, comprising:

(a) a base;

(b) two or more flexible means each having a fast impulse response to direct and indirect perturbations, said two or more flexible means positioned over said base, wherein said base supports said two or more flexible means; and (c) a cover to cover said two or more flexible means and allows said fast impulse response to said direct and indirect perturbations, wherein said base being heavier than the combined weight of said two or more flexible means and said cover, wherein one or more of said two or more flexible means maintains in an original position in absence of said direct and indirect perturbations, and flexes from said original position to a bent position in presence of said direct and indirect perturbations, wherein said bent position is characterized by one or more parts of said one or more of said two more flexible means flexed from their original position up to about 180 degrees with respect to said base, and wherein said safety marker device has a low center of gravity mainly due to said heavier base, whereby said low center of gravity facilitates in restoring said original position and whereby said heavier base facilitates said flexing.

24. The device as set forth in claim 23, wherein said deflections range from about 15 degrees to about 180 degrees.

25. The device as set forth in claim 23, wherein one or more of said two or more flexible means is a coil and said coil is shaped as a cone.

26. The device as set forth in claim 25, wherein each of said coils has 2 to 10 loops spaced between said base and the top of said marker device.

27. The device as set forth in claim 23, wherein one or more of said two or more flexible means is a rod.

28. The device as set forth in claim 23, wherein said cover is a meshed cover.

29. The device as set forth in claim 23, wherein said reflective material comprises one or more reflective bands.

30. The device as set forth in claim 29, wherein said reflective material comprises two reflective bands, wherein the first reflective band is positioned at about 3" (inches) from the top of said cover and said first band is about 6" (inches) in height, and wherein the second reflective band is positioned at about 2" (inches) from the bottom of said first reflective band and said second band is about 4" (inches) in height.

31. The device as set forth in claim 23, wherein said base is substantially rectangular.

32. The device as set forth in claim 23, wherein said base comprises an opening to allow for stacking with another safety marker device.

33. The device as set forth in claim 23, further comprising one or more light sources.

34. The device as set forth in claim 23, wherein said marker device has a barricade-like shape or a fence-like shape.

* * * * *